US005107668A

United States Patent [19]

Dammann

[11] Patent Number: 5,107,668

[45] Date of Patent: Apr. 28, 1992

[54] METHOD OF DOFFING PACKAGES OF A TEXTILE MACHINE AS WELL AS A TEXTILE MACHINE

[75] Inventor: Peter Dammann, Remscheid, Fed. Rep. of Germany

[73] Assignee: Barmag AG, Remscheid, Fed. Rep. of Germany

[21] Appl. No.: 503,319

[22] Filed: Apr. 2, 1990

[30] Foreign Application Priority Data

Jun. 19, 1989 [DE] Fed. Rep. of Germany ..... 3919855
Nov. 2, 1989 [DE] Fed. Rep. of Germany ..... 3936486
Feb. 23, 1990 [DE] Fed. Rep. of Germany ..... 4005821

[51] Int. Cl.[5] ..... D01H 9/14; D01H 9/00

[52] U.S. Cl. ..... 57/278; 57/276; 57/305; 57/306; 57/352; 242/35.5 A

[58] Field of Search ..... 242/35.5 R, 18 PW, 35.5 A; 57/266-267, 276, 278, 269, 300, 304-305, 306, 352

[56] References Cited

U.S. PATENT DOCUMENTS 3,224,692 12/1965 Nugent ..... 242/18 PW
3,690,577 9/1972 Schroeder ..... 242/18 PW
3,895,725 7/1975 Mayer ..... 214/38 R
4,026,095 5/1977 Kobatake et al. ..... 57/305 X
4,105,165 8/1978 Miyazaki et al. ..... 242/18 PW
4,108,388 8/1978 Schär ..... 242/35.5 A X
4,166,586 9/1979 Shirasuna et al. ..... 242/35.5 A X
4,291,529 9/1981 Schellenberg ..... 57/352 X
4,340,187 7/1982 Schippers et al. ..... 242/35.5 A
4,351,494 9/1982 Schippers et al. ..... 242/35.5 A
4,362,011 12/1982 Kikuchi ..... 57/352 X
4,451,007 5/1984 Ohkubo et al. ..... 242/35.5 A X
4,466,575 8/1984 Husges et al. ..... 242/18 PW
4,561,602 12/1985 Schippers et al. ..... 57/269 X
4,615,493 10/1986 Teranishi et al. ..... 242/35.5 A

FOREIGN PATENT DOCUMENTS 2431145 3/1975 Fed. Rep. of Germany ..... 242/18 PW
2128974 12/1975 Fed. Rep. of Germany .
3825273 2/1989 Fed. Rep. of Germany .
1297791 11/1972 United Kingdom .
1399891 7/1975 United Kingdom .

*Primary Examiner*—Daniel P. Stodola
*Assistant Examiner*—William Stryjewski
*Attorney, Agent, or Firm*—Bell, Seltzer, Park & Gibson

[57] ABSTRACT

A method and apparatus is disclosed for the doffing of a yarn winding machine which is composed of several side-by-side winding stations, and wherein identical packages having the same build and yarn length are produced on the several stations. The doffing procedure includes the simultaneous cutting of the yarns of all of the stations at the end of the winding cycle, the replacing of the full packages with empty bobbins, the threadup of the empty bobbins, and the simultaneous commencement of the yarn traverse at all of the stations.

9 Claims, 5 Drawing Sheets

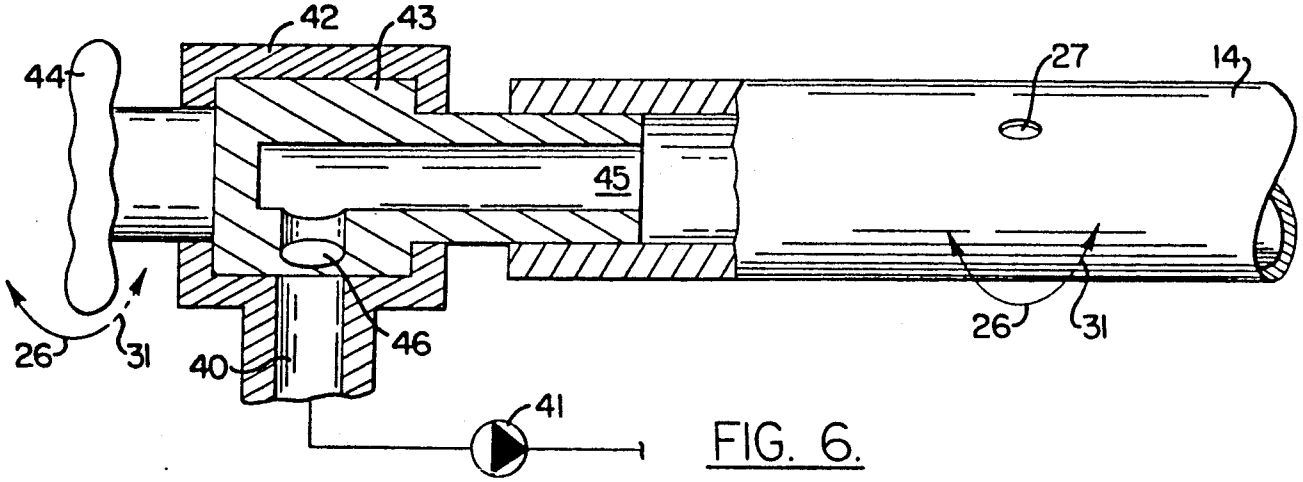
FIG. 6.
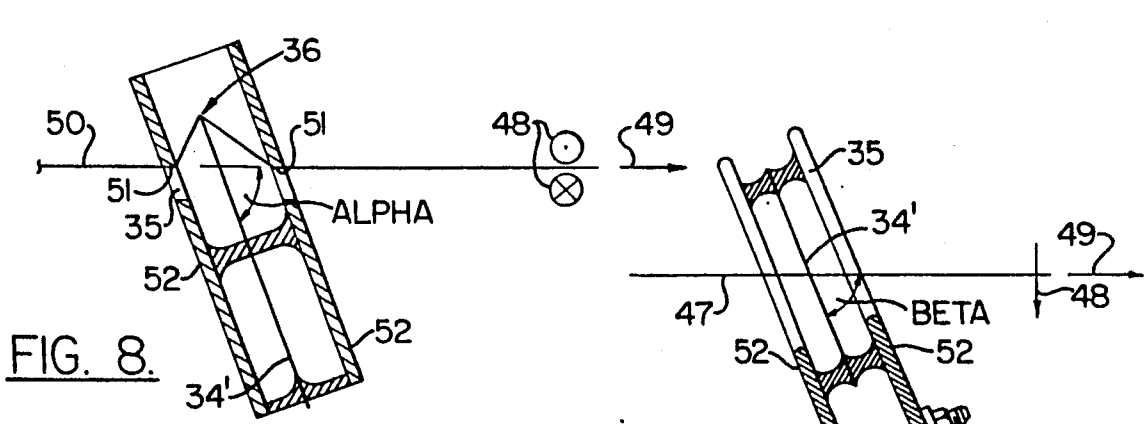
FIG. 9.
FIG. 8.
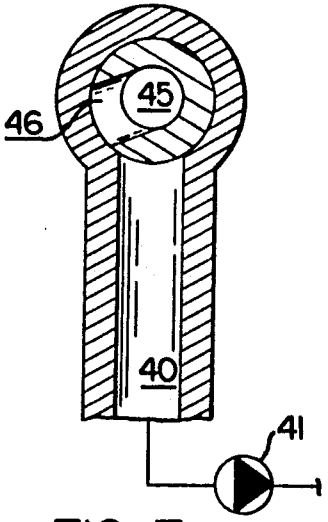
FIG. 7.

METHOD OF DOFFING PACKAGES OF A TEXTILE MACHINE AS WELL AS A TEXTILE MACHINE

BACKGROUND OF THE INVENTION

The present invention relates to a method and apparatus for doffing a textile yarn winding machine, of the type disclosed in German OS 21 28 974 and U.S. Pat. No. 4,561,602. In the known method and apparatus, the yarn winding machine comprises a plurality of side-by-side winding stations, and each processing station comprises feed systems, processing apparatus and a takeup system, which are arranged in a vertical plane. Identical machine parts of adjacent processing stations, such as, for example feed systems, and takeup systems, are laterally aligned with each other.

A preferred example of a textile machine of the described type is a false twist crimping machine, which serves to crimp smooth, synthetic filament yarns, and in which each processing station comprises in particular a feed system, a heater, a cooling zone, a false twist unit, a further feed system and finally a takeup system.

In the known method and apparatus, the packages of several takeup systems superposed in a column are doffed synchronously, i.e., in a fixed cycle.

It is the object of the present invention to provide a method and apparatus, which enable a fixed-cycle doffing of all takeup packages of a textile machine with simple means in a time-saving and flexible fashion.

The method of doffing all takeup packages of a textile machine in a fixed cycle in accordance with the present invention is useful in particular, when a plurality of identical packages are needed having exactly the same build and the same yarn length. For example, this requirement must be met for dye yarn packages, so as to obtain for all dye packages identical dye properties, such as, for example, absorbability of the dye, rinsability or penetration properties for the dye and rinsing liquids.

SUMMARY OF THE INVENTION

The above and other objects and advantages of the present invention are achieved in the embodiments illustrated herein by the provision of a doffing method which comprises the steps of simultaneously cutting the yarns at all of the winding stations upon the packages becoming full, and withdrawing the cut yarn end into a waste receptacle. The full packages are then replaced with empty bobbins at all of the winding stations, and the empty bobbins are then rotated at all of the winding stations. The advancing yarns are then guided onto the rotating empty bobbins at all of the yarn winding positions to form a yarn reserve winding on each of the bobbins, and the traverse of the yarns is then simultaneously commenced at all of the yarn winding stations so as to form cross wound packages on each of the rotating bobbins. It is also preferred that the guiding step includes cutting the yarns at a location between the bobbin and the waste receptacle at all of the yarn winding stations.

In accordance with the present invention, the fixed-cycle doffing occurs substantially by a simultaneous start of the traversing motion after the empty bobbins are inserted in the individual takeups, and by the simultaneous ending of the winding cycles of all takeups in that all yarns are simultaneously cut.

As a result, it is accomplished that the duration of the winding cycle for all takeup units is identical. During the doffing time, the textile machine continues to operate at crawl speed. To this end, both the takeup speed and the yarn advancing speed of all processing positions of the textile machine are reduced to crawl speed. The yarn advancing speed is the speed, at which the yarns advance to the takeup units during their production and/or processing. The start of the crawl speed can be obtained in a particularly simple manner by a central control of the rotational speed and the yarn advancing speed.

During the crawl speed operation, a sufficiently long servicing time is available to doff the packages and thread the yarns to the yarn reserve means of all takeup units without shutting down the machine. The crawl speed is as low as possible, i.e., just high enough to prevent damage to the yarn, which may lead to a yarn break. Such a damage occurs, when the yarn is stopped or advances at a too low speed, in particular when the working positions also include heating systems for the synthetic yarns, i.e. particularly in the case of false twist crimping machines. As long as no yarn break occurs, a damage to the yarns is harmless, since the quantity of yarn accumulating during the crawl speed operation is small and can be sucked off or wound to a bead of waste. The exchange of the fully wound packages with empty winding bobbins may be done by hand or by an automatic doffer. Known, for example, from German OS 38 25 273 is a multiposition textile machine, in which the packages are doffed by a doffer.

One end portion of an empty bobbin serves to form a transfer tail wind. In addition, a waste wind is wound in the end portion of an empty bobbin or on a portion of the winding spindle. To produce a transfer tail and a waste yarn wind, the yarn is guided over a so-called yarn reserve means, which comprises a suitable yarn guide.

To thread a yarn on an empty tube of the takeup unit associated thereto and to insert it into the pertinent a yarn reserve means, the invention provides for two different alternatives.

First, the yarn which advances continuously to a waste collecting device after having been cut, can be taken over by a transferring means, for example a suction gun, between a head yarn guide (fixed point) of the traversing system and the waste collecting device and be drawn out to form a loop. This means that the yarn length advancing from the head yarn guide to the suction gun and/or the yarn length traveling between the suction gun and the waste collecting device are first supplied via the yarn reserve means and the empty tube, whence they return to waste. In this event, it is necessary to cut the yarn loop, which is placed in the yarn reserve means, only in the region of the yarn length between the transferring means (suction gun) and the waste collecting device, after the yarn has engaged with the empty tube.

In another embodiment of the method, the yarn is taken over from the waste by a transferring means, for example, a hand-guided suction gun, specifically, the suction gun is held against the yarn between the head yarn guide of the traversing triangle and the waste collecting device, and the yarn length is cut between the suction gun and the waste. It is then possible to place the yarn on the empty tube of the takeup unit by means of the suction gun and insert same into the yarn reserve means. Subsequently, it is necessary to cut the yarn length advancing between the empty tube and the suction gun. In both embodiments, the yarn can be severed either by tearing or cutting.

The yarn inserted in the yarn reserve means advances to its empty tube rotating at crawl speed substantially in a normal plane until the yarns of all takeups are threaded on their empty tube and inserted in their associated reserve means. The normal planes, in which the yarns advance during the threading, are beside the winding range, in which the packages are formed during the operation. Once all yarns are placed on their empty tubes and inserted in their reserve means, the reserve means are synchronously released. As a result the yarns are advanced in a direction toward the center of the traverse stroke at a controlled speed, so that a transfer tail wind is formed beside the actual winding range. As soon as the yarns reach the region of the traverse stroke, they are grasped by a self-catching yarn guide of the yarn traversing system. As a result the traversing motion for all takeup units starts simultaneously.

If it is desired to achieve the condition that the yarn processed at the start of the traversing motion correspond to the quality of the yarn processed at the end of the cycle, it is preferred to release the reserve means only after the operating speed is reached. If the reserve means are released only after the operating speed is reached, this method will turn out to be especially suitable in those cases, in which the yarn is subjected to a temperature treatment, inasmuch as it ensures that the dwelling times of the yarn on its heating system corresponds to the rated time from the start to the end of a winding cycle. This is particularly important for false twist texturing machines.

In yet another variant of the method, the guide systems of all reserve means are synchronously disengaged, so that the traverse motion for all takeups starts at the same time at a speed lower than the operating speed. Then the rotational speed of the winding tubes is increased while simultaneously accelerating the speed of the advancing yarn.

The fact that the traverse motion starts before the final operating speed is reached offers the advantage that the waste wind becomes smaller. In one embodiment it is possible to obtain at the start of the traversing motion and at about 70% of the operating speed a yarn quality, which does not differ substantially from the end quality at the operating speed.

Another advantage of this variant of the method is that the operating times can be increased for all takeup units operating in the same cycle. As a result, there is likewise more time available for the doffing of the other takeups. These facts take into account that the takeup units operating respectively in the same cycle are doffed only during the winding operation of the other takeups.

A special feature of the invention is that the winding operation for all takeup packages is simultaneously stopped by cutting the yarn, it being unnecessary to disengage the yarn traversing systems. This is accomplished in particular in that the yarns while being still traversed are guided to the catching zone of the waste collecting device, so that they can be automatically caught by the latter when they are cut.

In the preferred embodiment, the waste collecting device is a suction tube which is connected to a partial vacuum and extends before and parallel to several yarn traversing systems, closely adjacent to the traversing planes crossed by the yarn. The suction tube is provided with a suction opening for each yarn in the area of the traversing plane, and a yarn trap is positioned in the catching area of each suction opening and which is adapted to be moved into the traversing plane for catching and guiding the yarn. The yarn traps of the several yarn winding stations can be simultaneously actuated, and the yarn trap of the illustrated embodiment comprises a guide bar parallel to the traversing plane, and which is mounted to the suction tube and is provided in the area of the suction opening with a notch perpendicular to the traversing plane. Also, the suction tube is rotatable between a non-operative position and an operating position, in which the suction openings face an associated yarn path. The guide bars extend parallel to the traversing plane in the non-operative position and extend into the traversing plane when the suction tube is rotated to its operating position.

In a specific embodiment, the suction openings face the associated yarn path, and the yarn traps or slots extend in a circumferential direction on the outer circumference of the suction tube and proceed from the suction openings. Also, the slots are positioned such that they can be moved into the associated traversing plane when the suction tube is rotated about its longitudinal axis. This construction has the advantage that the lengthening of the suction openings in circumferential direction forms in a simple manner yarn traps, which reliably catch the traversed yarn without additional measures. To this end, the suction tube itself serves during the operation as a deflecting rail or as a support of the deflecting rail, which is arranged within the traversing triangle and bends the latter in two planes, which extend relative to each other at an angle.

The rotatability of the suction tube may also be used to engage and disengage a guide member which forms the yarn reserve on the bobbin and/or to start the suction effect of the tube for doffing the packages and subsequently stop same. The use of the suction tube as a waste collecting device offers a special advantage, when a common suction tube is available for horizontally adjacent winding stations, which suction tube serves as a common waste collecting device for the horizontally adjacent stations and simultaneously for the actuation of the yarn traps, cutting blades and yarn reserve means of these stations.

During a winding cycle, the suction can be stopped with simple means. To cut off the suction, the suction tube may be separated from a blower generating a partial vacuum by means of a valve which closes when the suction tube is rotated. Another embodiment provides that, as the suction tube is rotated, an electric switch is actuated which disconnects the blower. To accomplish that the suction for all takeups is started and stopped, the suction openings of the individual stations are arranged along a common surface line of the tube, so that the catching areas of the suction openings simultaneously catch all yarns, when the suction tube is rotated about its longitudinal axis in the direction of rotation of the started suction system.

After all yarns are threaded on the empty winding bobbins, the rotation of the suction tube in the direction of its disconnection accomplishes that the yarns do not pass over the catching areas of the suction openings while they are being traversed. In other words, the suction openings are removed from the traversing planes of the yarns by the rotation of the suction tube.

Before a yarn is cut from the package, it is moved to an exactly defined position relative to the suction opening, so that a cut yarn is always reliably caught even when the underpressure of the suction tube is low.

In the present application "traversing plane" is understood to be the surface, which is defined by the traversing triangle of the yarn. This surface need not extend in one plane. Depending on the path of the yarn guidance, it can also be a curved surface. When the yarn is deflected, for example, by means of a rail transverse to the yarn path between the fixed point of the traversing motion and the traversing yarn guide, the traversing triangle comprises two planes extending relative to each other at an angle, which are bent along the deflecting line.

For the simultaneous cutting of all of the yarns, a cutting blade holder having a cutting blade which extends transversely to the direction of the yarn path is moved into the traversing plane at each of the winding positions at the end of the winding cycle. The cutting blade holders are attached to the rotatable suction tube, and they are adapted to enter into the traversing plane by rotating the suction tube into its operative position. Also, each cutting blade holder is preferably provided with a guide edge, and such that the guide edge and the cutting blade form a wedge- shaped narrowing slot, the opening of which is directed toward the yarn reciprocating in one traversing direction.

It is important that the cutting blades are moved into the yarn path only at the end of a winding cycle. It is possible, though, to use also active cutting blades, such as, for example scissors. Preferred, however, are passive cutting blades, which are stationary blades, and over which the yarn is drawn under a longitudinal tension. When using scissorlike cutters, it is important that all cutting blades are synchronously actuated, which can be realized mechanically by a corresponding operative connection together with a common drive, or electromagnetically by supplying a current impulse at the same time.

In comparison therewith, the embodiments of the cutting blade as specifically described herein have the advantage that the reciprocating motion of the yarn is used for the cutting. As a result of the traversing motion, the yarn is guided over a blade directed transversely to the direction of the yarn path and cuts itself automatically. The cutting blade may also extend obliquely to the direction of the yarn path. In this instance, the blade forms with the center line of the traversing triangle an angle which is not 90°, and is preferably directed with its end which is not yet being contacted during the traversing motion, toward the takeup package.

Preferably, the cutting blade holders are connected with the rotatable suction tube, so that no further transmission elements need be provided for actuating the cutting blades.

The advantage of providing the cutting blade holder with a guide edge as described above is that for a reliable self-cutting of the yarn it will be necessary to adjust the optimal parameters, in particular, the angles at which the blades are contacted, only for the yarn advancing from one of the two traversing directions. The yarn advancing from the one traversing direction is lifted over the cutting blade holder, in that it crosses the edge, and upon its return motion the yarn is forcedly traversed into the slot for cutting. Preferably, the holder with the blade is so arranged that only the yarn moving outwardly from the center of the traverse stroke is put into contact with the blade. This ensures that the yarn is always under an adequate tension. It is also possible to use a waveshaped, sharpened cutting edge.

Of importance for the quality of the package is that the yarn end is well locatable. For this reason, a yarn cut is desired, which extends in one plane, if possible a plane perpendicular to the yarn axis. In particular, however, it is necessary to avoid damage to the individual filaments, which also leads to an entanglement thereof. To this end, it is further proposed to arrange the cutting blade in a plane such that the end of its cutting edge is closer to the winding tube than its beginning. This accomplishes that the relative speed of the yarn in the direction transverse to the cutting blade is low and, ideally, equal to zero. As a result, the relative movement of the yarn is limited to a movement in direction of the cutting blade, i.e., a movement, which by experience leads to a clean cut in one separating plane. To optimize the cutting forces, it is also possible to provide for a height-adjustable arrangement of the cutting blade, so that its inclination to the traversing plane is variable. This allows to further improve the cutting effect of the knife, since the inclination causes an additional tensioning of the yarn during a synchronous cutting operation of all yarns. The direction of the inclination depends, among other things, also on the arrangement of the cutting blade in the slot. If need be, the optimal inclination can be found by tests. However, it preferably should be adjusted such that the yarn undergoes an increase in tension, when it traverses across the cutting edge.

A further improvement of the cutting effect can also be accomplished by providing that the angle between the plane of the cutting blade and the traversing plane be adjustable and is other than a right angle, such that the cutting edge points toward the arriving yarn. Stated in other words, it is desirable to be able to adjust the plane of the blade such that the angle between the direction of the advancing yarn from the cutting edge and plane of the cutting blade is greater than 90°. As a result of the inclination of the plane of the blade to the yarn advancing thereto, the component of the threadline direction pointing in a direction toward the package contributes to an irreversible tensioning of the yarn while being cut.

In the specific embodiment of the invention, the cutting blade holder is provided with guide edges on both sides of the plane of the cutting blade, and so as to form a wedge-shaped narrowing slot. This construction has the advantage that the yarn is further tensioned. More particularly, the cutting edge extends first below the two guide edges, then it obliquely crosses same and finally it raises above the guide edges. The lateral spacing between the cutting blade and the guide edges is sufficiently large that the yarn is not clamped therebetween. As the yarn traverses thereinto, it is pulled during its transverse movement by the cutting edge below the guide edges and is thus tensioned in addition. The combination of these features provides for a cutting of the yarn such that it corresponds to the cutting of a yarn in a static condition, i.e., by hand, which results in a clean cut.

The yarn reserve guides are preferably attached to the suction tube so that they can be pivoted into the yarn path by rotation of the tube. This provides for the simultaneous release of the yarns when the tube is pivoted in the operative direction toward the inoperative position.

The start of the crawl speed means first that the rotational speed of all feed systems and the takeup is reduced at the same ratio without changing the gear transmission ratios. Not considered here for the time being is that a shutdown of the traversing system results in a reduction of the actual takeup speed, which is geometrically composed of the circumferential speed of the package and the traversing speed. To achieve a tensioning of the yarn, the rotational speed of the winding spindle with the empty tube inserted thereon is automatically controllable in the meaning of an increase irrespective of the rotational speed of the feed systems during the crawl speed operation. This offers the advantage of a waste wind and transfer tail wind, which are low in volume and densely wound. The increase of the rotational speed of the winding spindle may be suitably coupled with the rotation of the suction tube.

BRIEF DESCRIPTION OF THE DRAWINGS

Some of the objects and advantages of the present invention having been stated, others will appear as the description proceeds when taken in conjunction with the accompanying drawings in which

FIG. 6 is a fragmentary sectional view illustrating the valve at the end of the suction tube;

FIG. 7 is a sectional view taken along the line 7—7 of FIG. 6;

FIG. 8 is a sectional view of the yarn cutting apparatus and taken in the plane of the traversing yarn and substantially along the line 8—8 of FIG. 5; and FIG. 9 is a view similar to FIG. 8 but taken in a plane perpendicular to the yarn traversing plane.

DETAILED DESCRIPTION OF THE PREFERRED EMBODIMENTS

Referring more particularly to the drawings it should be noted that the drive of the traversing system and the friction roll necessary to drive the package, and which are conventional, are not shown. Also, the following description will first refer to all Figures. Special features, deviations and differences will be pointed out subsequently.

Figure 1:
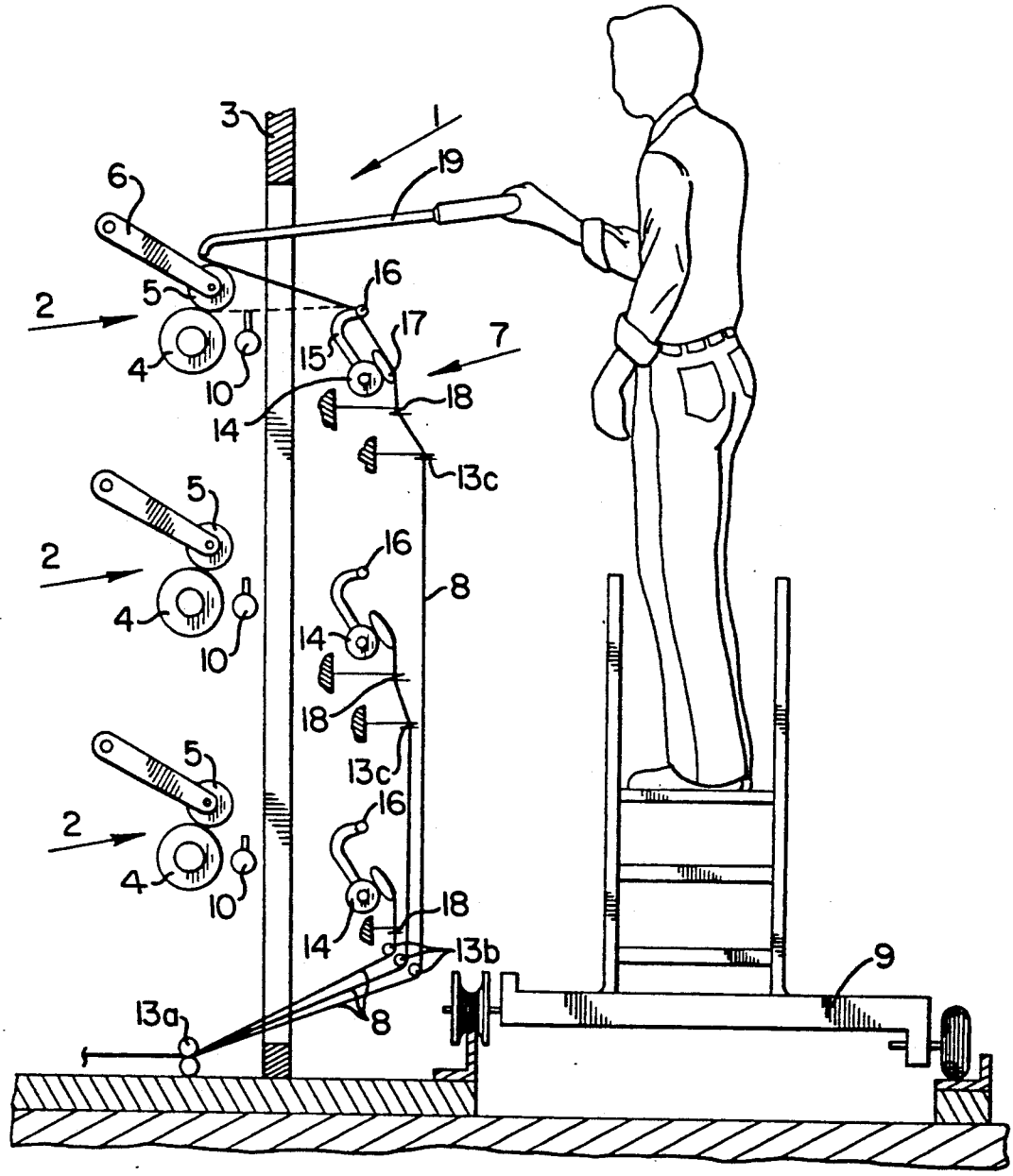
FIGS. 1 and 2 are perspective side elevation views of a yarn winding machine which embodies the features of the present invention.
Figure 2:
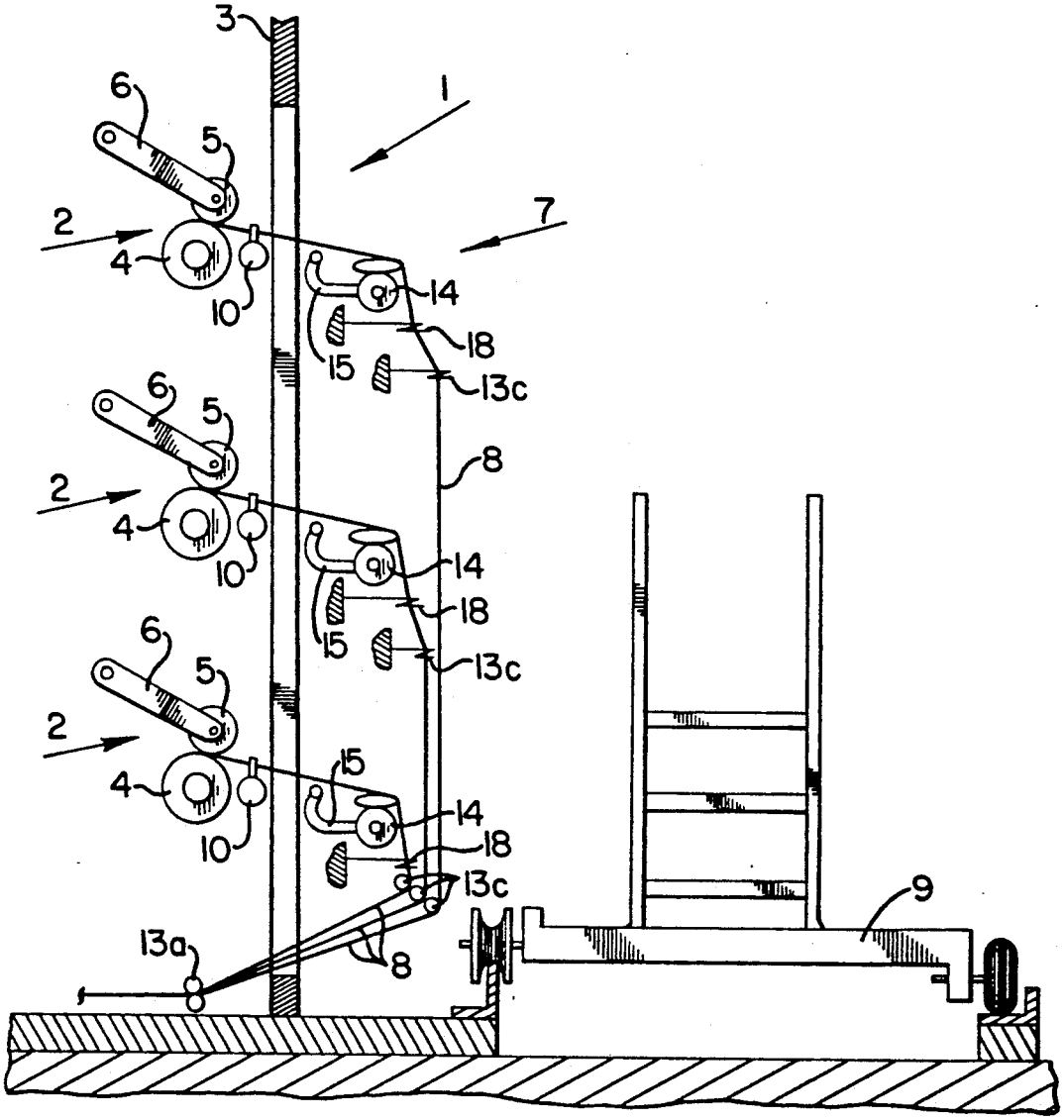

Shown in FIGS. 1-2 are only a feed system 13*a* of the textile machine and the takeup units downstream thereof. It should be noted that the three yarns 8 are produced or processed on working positions arranged side by side and supplied by three successive feed systems 13*a*, one aligned to the other. However, the takeups 2 for these three yarns are superposed in a column and cover the working stations in the longitudinal direction of the machine. The reason therefor is that the gauge of the working positions is substantially smaller, by about one third, than the gauge of the takeups 2, which is predetermined by the length of the package.

Figure 5:
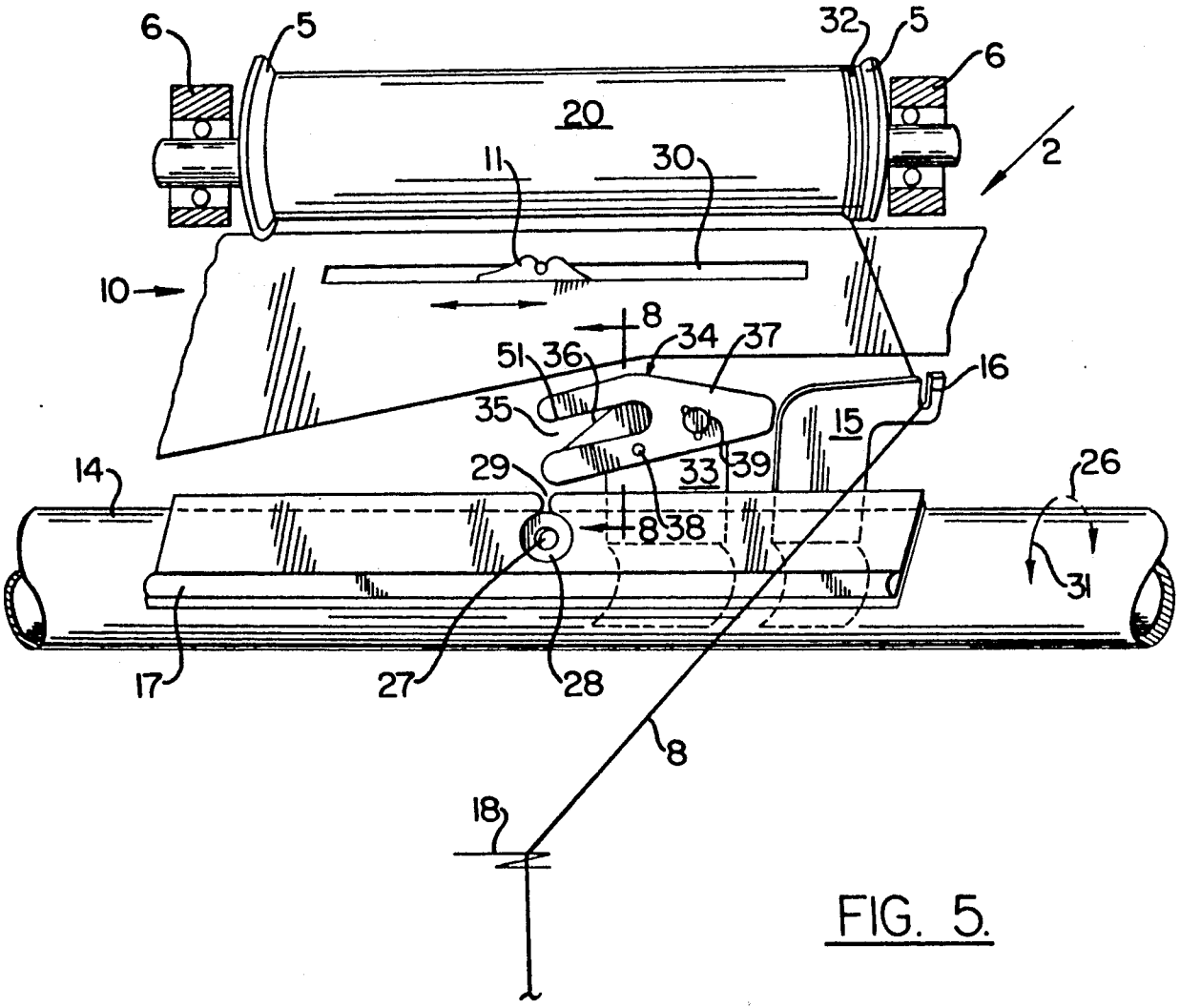
FIG. 5 is a somewhat schematic perspective view of a winding station in accordance with the present invention.

As noted above, the machine possesses a plurality of groups of winding stations each comprising three vertically superposed units 2. Shown in the Figure is a group of three winding stations, which are mounted on a machine frame 3. Each winding station comprises a drive or friction roll 4 and a rotatably supported winding bobbin 20 (FIG. 5). The winding bobbin 20 is supported at the end of one of two parallel pivot arms 6, such that the bobbin 20 and resulting package can swing away from the drive roll 4 as the package diameter increases.

As is shown in FIG. 5, the winding spindle for a rotatable mounting of the bobbin is formed by the two clamping plates 5, which are rotatably supported, one in alignment with the other, at the free ends of the pivot arms 6. The clamping plates, as cannot be seen, are able to perform a resilient movement toward the inside, so that they clamp between them an empty tube or bobbin 20. A yarn traversing system 10 precedes the takeup unit. As is shown in FIG. 5, the yarn traversing system comprises in particular a reciprocated yarn guide 11, which can be driven by a cross-spiralled roll (not shown). The yarn guide is adapted to traverse over a certain length 30. In the present application, this length 30 is also referred to as traverse stroke or winding length. As a result of its traversing motion, the yarn describes during its takeup a traversing triangle, whose apex is defined by a head yarn guide 18 which is fixed, and whose base is formed by the traverse stroke 30 of the traversing yarn guide 11. Located on the side of the stations facing the operating side are guide means 7 (FIGS. 1 and 2) for the advancing yarns 8.

Arranged between each guide means 7 and the associated takeup unit 2 is a yarn traversing system 10, which reciprocates the yarn for winding transversely to its direction of advance. In order for the machine operator to reach all takeup units, a ladder 9 is used, which is movable along the front of the machine.

Each guide means comprises a suction tube 14, which is supported for rotation about its longitudinal axis and which extends along the length of the machine. The suction tube fixedly mounts a guide arm 15 facing the takeup, and thus the guide arm 15 rotates along with the rotation of the suction tube. The guide arm accommodates a yarn guide 16, and the guide 16 on arm 15 moves the yarn 8 to the empty bobbin 20 outside the traversing range to form a yarn reserve during the doffing procedure, as more fully described below.

The guide means 7 further comprises a bar 17 which extends in the yarn path of the traversing triangle and is mounted on the suction tube. This bar is arranged between the fixed point 18 and the path 30 of the traversing yarn guide 11 and parallel thereto, and serves as a deflecting rail for the yarn advancing from the bottom. The head yarn guide 18 is formed by a stationary eyelet.

The suction tube 14 extends over several takeup units 2, which are horizontally arranged side by side in one tier, of which only one is shown. In the area of each traversing triangle, the suction tube is provided with a radial opening 27 in the wall thereof. In the longitudinal range of each suction opening 27, the deflecting bar 17 is provided with a slot 29 which extends radially from the jacket opening 27. Each slot 29 is deep enough so that it surrounds its suction opening 27 as a spaced-apart recess 28. This slot 29 serves as a yarn trap. When moving into the traversing plane, it is its task to catch in the recess the yarn, which is reciprocated along the deflecting bar 17 by the traversing system, and to guide it into the catching area of the suction opening 27 irrespective of any further traversing motion. It is therefore necessary that the catching area of the suction opening be at least as large as the area of the recess 28 in the deflecting bar.

As to the further details of the apparatus and its components illustrated in the embodiment, in particular, the cutting blades, reference is made to the following description of the operation.

FIG. 2 shows the textile machine in operation, i.e., at the beginning of a winding cycle. The bobbins, or respectively the packages forming thereon, rest against their associated friction rolls 4 and are rotatingly driven by the latter.

Since the winding cycle of all yarns, as will be explained hereinbelow, starts at the same time, and since all yarns are delivered at the same speed and wound at the same speed, all packages are fully wound at the same time. They are then doffed.

A package doff comprises the following phases:

1. Catching the yarns in the suction area of the waste collecting device.
2. Cutting the yarns.
3. Exchanging each of the full packages for an empty bobbin.
4. Threading the yarns on the empty bobbin.
5. Inserting the yarn into the guide means of the yarn reserve device and winding a waste wind.
6. Releasing the guide means of the yarn reserve device and winding a transfer tail.
7. Start of the winding cycle by engaging the yarn with the traversing system.

During the phases 1 and 2, the delivery and the takeup speeds are reduced to a crawl speed.

During the phases 6 and 7 the speed is increased to the speeds of a normal operation.

During phase 1 the following occurs. As can be noted from FIGS. 3-5, the guide arm 15 as well as a holder 33 with a cutting blade 34 are rotated along with the rotation of the suction tube. Further a special valve arrangement, which is shown in FIGS. 6-7 and will be described further below, supplies an underpressure to the suction tube, so that a suction current develops in the suction openings.

In phase 1, the suction tube is now rotated such that the suction openings 27 turn toward the yarn path, and the slot 29 with the recess 28 penetrates through the traversing plane of the traversing triangle. As a result, the yarn, which is first guided along the deflecting bar 17, drops into the recess 28. The yarn now advances in the normal plane and over the suction opening and is here exposed to the suction current. However, the traversing system continues to reciprocate the yarn between the recess 28 and the traversing system 10.

As best seen in FIG. 5, along with the rotation of the suction tube in direction of arrow 26, the holder 33 with the cutting blade assembly 34 is also rotated into the traversing plane and the yarn path between the recess 28 and the reciprocating yarn guide 11. The assembly 34 mounts a cutting blade 34' in the manner further described below.

It should be expressly stated that the cutting blade assembly 34, which is subject matter of the following description, is not used only for the present method of a synchronous doffing, but can also be applied to other fields of the yarn technology. In the rotated position, the holder 33 and the cutting blade assembly 34 extend in a cutting plane, which intersects the traversing plane. The cutting line between the cutting plane and the traversing plane has a component, which extends parallel to the winding axis of the traversing path. Preferably, however, the cutting line also has a component which extends perpendicularly thereto. The cutting blade holder is provided with a slot 35 extending in the traversing plane, into which the traversing yarn enters from the left. Stated otherwise, the slot is open toward one side. One of the longitudinal edges of the slot (in FIG. 5, the bottom edge of the slot) is formed by the cutting edge 36 of the cutting blade 34'. The other longitudinal edge of the slot, (the upper edge thereof) is formed by two guide edges 51 (note FIG. 8). Each of these guide edges 51 extends in a plane, which is parallel to the plane of the cutting blade and closely adjacent thereto. Thus, a guide edge extends on each side of the plane of the cutting blade. In a practical embodiment, the cutting blade holder 33 comprises two lateral plates 52 which enclose a slot 35. The lateral plates 52 accommodate between them the cutting blade 34' while being somewhat spaced apart from both sides, in such a manner, that the cutting edge 36 projects into the slot 35 and forms the lower edge thereof such that the slot narrows from its opening to its inner end, and that finally the guide edges 51 cover the cutting edge 36. Thus, the slot narrows for the yarn which enters thereinto as it is traversed. As a result of the narrowing, the yarn is pressed against the cutting edge, whereby its tension increases.

FIG. 8 is a sectional view of the cutting blade holder 33 taken approximately along the line 8—8 of FIG. 5. As can be seen, the cutting blade holder 33 comprises two lateral plates 52, which are secured to each other by a clamping bolt 39 thereby clamping between them the cutting blade 34'. For an exact adjustment of the inclination or respectively the oblique position of the cutting edge 36, it is possible to adjust the cutting blade after loosening the clamping bolt 39, and to secure it again in position after tightening the clamping bolt 39.

FIG. 9 is a sectional view of the cutting blade holder 33 taken approximately perpendicular to the traversing plane along the slot 35, and perpendicular to the view of FIG. 8. As can be noted from these Figures, the lateral plates 52 of the blade holder and the cutting blade 34' are not in surface contact with each other, but form between them a spacing, which prevents the yarn from being clamped. This further avoids that yarn remnants and lint accumulate.

As seen in FIG. 8, the plane of the cutting blade, i.e. the plane in which the blade 34' is located, is inclined in such a manner that the angle between the plane of the cutting blade and the traversing plane is not 90°. This angle is indicated at "alpha." Thus, the plane of the cutting blade is inclined such that the cutting edge 36 is directed against the advancing yarn. As a result, the angle alpha, which is less than 90°, is located behind the plane of the cutting blade when viewed in direction of the yarn path.

As seen in FIG. 9, the blade 34' of the cutter is arranged obliquely to the center line of the traversing triangle 47, when the holder of the blade, which is attached to the suction tube, is in its operating position. With respect to the center line of the traversing triangle, the blade 34' is rotated such that the cutting edge approaches the winding bobbin from its beginning at the entry of the slot 35 to its end. Consequently, the angle beta, which is formed by the cutting edge with the center line of the traversing triangle, is smaller than 90° and greater than 0° behind the cutting blade, when viewed in the direction of the advancing yarn.

A special feature of the illustrated embodiment is that the cutting blade holder 33 is provided with only one slot, which is directed in only one direction of the traverse. A precondition of such an arrangement is that the yarn is traversed into the slot always from one direction. For this reason, the cutting blade holder is provided on its end facing away from the slot with a yarn guide edge 37, which extends obliquely through the traversing plane and points substantially in the direction of the traverse. When the yarn traverses, as shown in the FIG. 5, from the right to the left, it moves upward along the guide edge and jumps over the blade holder 33. During the next traverse stroke from the left to the right, the yarn is traversed into the slot and cut.

As the cutting blade holder is rotated into the traversing plane, the following occurs. First, underpressure is supplied to the suction tube, so that an air current is drawn in by each suction opening 27. At the same time, the deflecting bar 17 with the slot 29 penetrates through the traversing plane. Likewise, the yarn guide edge 37 of the cutting blade holder 33 moves through the traversing plane. Assuming that the yarn advances from the right at the moment of the rotation, i.e., from the side of the cutting blade holder facing away from the slot 35, the yarn, as it traverses, slides along the guide edge 37, over the slot, to the other end of the traverse stroke. As it returns, it enters into the slot 35 and simultaneously drops into the slot 29 and recess 28 of the deflecting bar 17. The yarn is then guided over the suction opening 27 and continues its traversing motion between the slot 29 and the traversing yarn guide 10. In so doing, the yarn contacts the cutting blade 36. Since the latter submerges to the right below the guide edges 51 of the slot, the yarn is tensioned in a zigzag course on the cutting edge 36, as is shown in FIG. 8. Due to the fact that the plane of the cutting blade approaches the package from the opening to the end of the slot (note angle beta in FIG. 9), it is accomplished that the yarn has no relative speed transverse to the cutting edge 36. More particularly, the cutting edge is aligned along the resultant of the advancing movement 49 of the yarn and the lateral reciprocating movement 48 of the yarn when viewed in a direction perpendicular to the tranversing plane, i.e. FIG. 9. Consequently, the yarn is cut in only one plane. The cutting operation is thus closely simulated to the cutting of a yarn on a cutting edge in a static condition. Since furthermore the plane of the cutting blade is inclined toward the direction of the yarn path (note angle alpha in FIG. 8), an adequate yarn tension is additionally provided on the cutting edge 36.

Stated in other words, since the cutting blade is inclined in the direction of the package, a self-increasing clamping effect of the narrowing slot, and thus a reliable cutting of the yarn is also produced, inasmuch as the yarn traversed thereinto undergoes a tensioning. The inclination or respectively oblique position effects an additional tensioning of the yarn as it moves over the cutting edge, since the yarn is forcedly raised above the traversing plane until it is cut under its own tension.

As a result of the traversing motion, the yarn pulls itself irreversibly into the narrowing so that one place along the length of the yarn slides along the cutting edge 36. The cutting edge moves obliquely through the traversing plane, so that while crossing the cutting edge the yarn is further removed from the traversing plane. It is pulled by the cutting edge 36 below the guide edges 51 and additionally tensioned. This accomplishes that the looping angle of the yarn on the cutting edge 36 further increases, whereby the frictional forces between the yarn and the looped cutting edge are further enlarged. This continues until the yarn is cut.

As a result of the increasing frictional force, which the looped cutting edge exerts on the yarn, the tension of the yarn which is further wound, increases, which likewise favors the cutting operation.

Since the yarn advancing from the left is also caught by the slot 29 of the recess 28, it is necessarily located with its cut end in the catching area of the suction opening, and consequently removed by the suction tube 14 after having been cut.

After the cutting operation, the machine is in condition for the start of phase 3, namely the exchange of each full package with an empty tube. After the yarn cutting operation, the continuously advancing yarn 12 is guided into the suction tube and removed by the latter, as shown in the two lower winding stations of FIG. 1. It is now possible to remove the full packages from their holders and replace them with empty bobbins 20. This doffing operation has already occurred in FIGS. 1 and 5. Thereafter, the operation proceeds to phase 4, namely threading the yarns on the empty tube, and to phase 5, inserting the yarns into the guide means of the yarn reserve device and returning the yarns to the empty bobbins. Phase 4 and phase 5 substantially involve the same manipulations. It should be noted that the takeups are not simultaneously serviced during the phases 3, 4 and 5.

Phases 4 and 5 will be described in particular with reference to FIGS. 1, 3 and 5. However, before so doing, it should be noted that an arm 15 with a guide 16 is attached on the suction tube for each takeup, the guide being moved to the height of the traversing plane when the suction tube is rotated to its operative position.

Referring to the upper takeup of FIG. 1 and to FIG. 4, a first threading method will be described. A second threading method will be described with reference to FIG. 3.

On the upper takeup of FIG. 1, an operator places a yarn by means of a transferring device 19 on an empty bobbin. As to the apparatus for accomplishing this operation, reference is made to FIGS. 3 and 4, which are side views of the structure for taking over the advancing yarn from the suction tube and for threading the yarn on the empty tube 20. A suction air current flows through the suction tube 14. This suction air current first guides the yarn advancing from the fixed point 18 of the traversing system until it is grasped by the transferring device, in most cases a suction gun 22. The transferring device serves to take over the yarn, which at first continues to advance into the suction tube 14, and to then engage it with the reserve means and the empty bobbin 20. To this end, it is necessary in both cases to sever the yarn length entering into the suction tube 14. In both cases, a cutting blade 23 serves to cut the yarn, which blade is arranged on the suction tube in the case of FIG. 3, and in the suction gun 22 in the case of FIG. 4. In both cases the cutting blade is inclined toward the yarn path in the direction of the suction. As a result of this inclination of the cutting blade toward the yarn path, the yarn is able to pass unhindered over the blade in one direction, the direction of suction. In the other direction of its advance, however, the yarn is caught by the yarn cutting edge 24 of the blade 23 and is cut.

Figure 3:
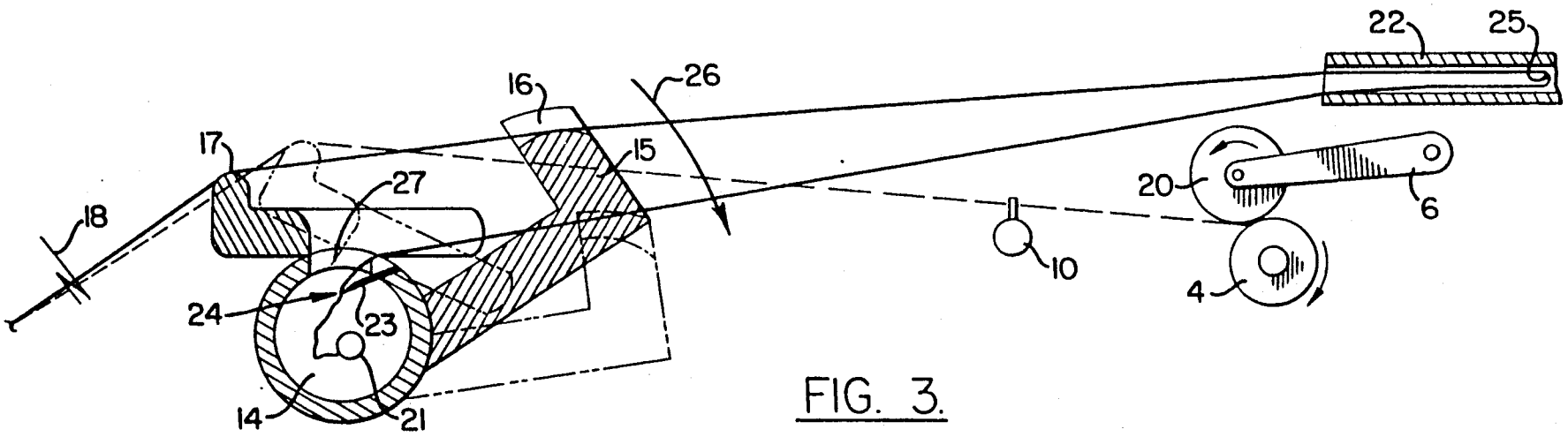
FIGS. 3 and 4 are fragmentary sectional views of a winding station together with the suction tube.
Figure 4:
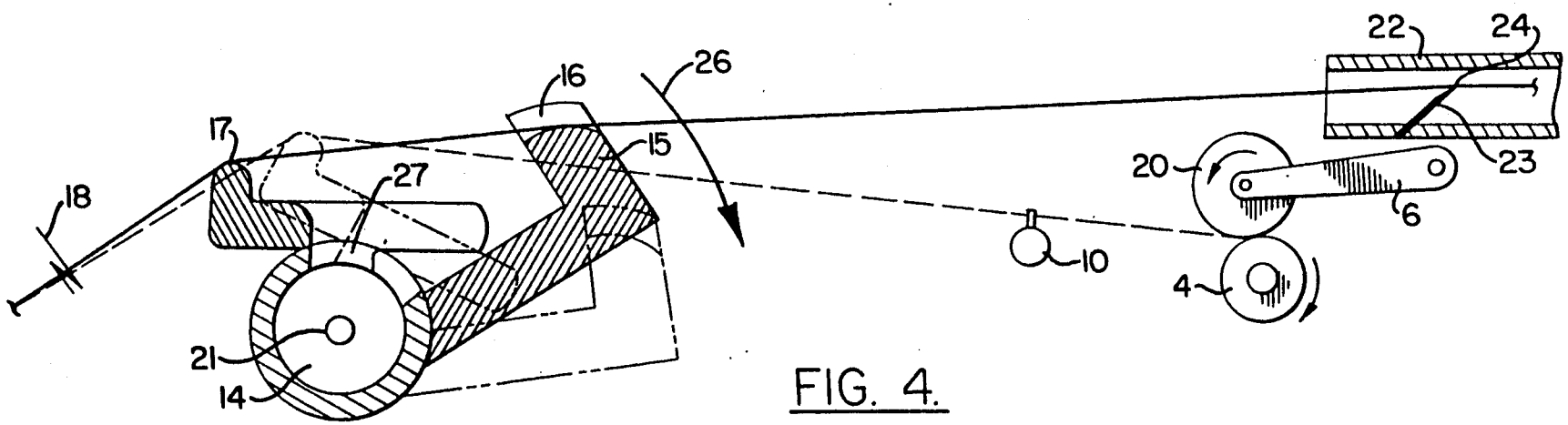

In the first method of FIG. 3, the yarn, which first enters into the suction tube is taken over by the suction gun 22 and drawn out to a loop. This occurs in that the yarn between the fixed point, i.e., the head yarn guide 18, and the suction tube is first pulled into the suction gun 22, and reversed therein in its direction by 180°, thereby forming a loop 25. The returning yarn segment continues to be in the suction opening 27 of the suction tube 14. The other yarn segment entering into the suction gun is now pulled out so far that either both yarn segments or only one yarn segment of the loop 25 can be placed on the circumference of the empty bobbin. To this end, at least the yarn segment moving from the fixed point of the traverse system into the suction gun is placed into the guide 16 of guide arm 15, so that the yarn advances to the empty bobbin outside the range of the yarn traversing system 10. Then, the yarn is placed on the circumference of the empty bobbin. The empty bobbin grasps one or both ends of the loop with a suitable catching slot and winds the yarn, which continues to advance, outside the traversing range of the empty tube to a waste yarn bead 32 (FIG. 5). The suction force of the gun 22 on the yarn loop 25 is greater than the suction force of suction tube 14. Consequently, the yarn segment between the empty bobbin and the yarn cutting edge 24 is considerably tensioned latest during the grasping by the empty bobbin so that the yarn is pulled out of the suction opening 27. In doing so, it is guided over the cutting blade 23, which is inclined in direction of the suction. As a result, the yarn contacts, as it is pulled out, the cutting edge 24 in such a manner that it is cut on the cutting edge 24.

The alternative threading method is illustrated in FIG. 1 and explained with reference to FIG. 4. In this method, the yarn is caught between the head yarn guide 18 and the opening 27 of the suction tube 14 by a hand-guided suction gun 22. To this end, the operator holds the suction gun 22 in the vicinity of the yarn path and then cuts by hand the yarn between the suction gun 22 and the opening 27 of the suction tube 14. The free yarn end advancing at crawl speed is now grasped by the suction gun 22.

In this case, the yarn does not form a loop, but enters into the suction gun 22 rather than into suction tube 14, the former also being again connected with a suitable waste collecting device (not shown). The threading differs from that of FIG. 3 in that the yarn segment entering into the suction gun 22 is placed into the catching means, for example, into a slot (not shown) arranged on the circumference of the empty bobbin 20, and simultaneously into the guide 16. After having engaged with the empty bobbin 20, the yarn which continues to enter into the suction gun is under a very high tension so that it is pulled out of the suction gun 22. This means that the yarn is severed in the opening area of the suction gun by the cutting edge 24, as soon as it is tensioned after having been threaded on the empty bobbin. Thus, a significant difference exists in that the cutting occurs now in the yarn suction gun rather than in the stationarily arranged suction tube.

The following will apply to both alternatives of the threading method. Since the guide 16 is outside the traversing range, the waste wind is formed likewise on the empty bobbin, but also outside the traversing range and the winding range.

After having been caught by the empty bobbin, the yarn advances first over the deflecting bar 17 and through the guide 16 to the empty bobbin 20, where it forms a waste wind 32 without traversing.

The condition of winding a waste according to phase 5 will continue until all yarns of the textile machine are threaded on their respective empty bobbin. The quantity of yarn, which is wound as waste is small, since the entire textile machine is switched to crawl speed after phase 2, the cutting of the yarns. To produce a stable waste wind, it is possible to somewhat increase the rotational speed of the empty tube relative to the delivery speed of the yarn, so that the yarn is under a sufficiently high tension as it advances onto the beaded waste wind, though the yarn advances only in a normal plane and is not reciprocated by the traversing system.

Once all yarns are threaded on an empty tube, phases 6 and 7 follow. Specifically, in phase 6, the guide means of the yarn reserve device is released and a transfer tail is wound, and in phase 7, the winding cycle starts by engaging the yarn with the traversing system. Phase 6 is initiated by rotating the suction tube. Both phase 6 and phase 7 occur simultaneously for all takeups and all working positions. Simultaneously with one of phases 6 or 7 the speed of the textile machine is increased to its normal operating speed.

When rotating the suction tube, the guide arm 15 is rotated in direction 26. As a result of the rotation of the suction tube to the dotted position, the deflecting bar 17, which is between the fixed point 18 of the traversing system and the empty tube, is raised to such an extent that the yarn is lifted out of guide 16, while the latter is lowered at the same time. Since the fixed point 18 of the traversing system forms the apex of the traversing triangle, and since, however, the guide 16 is outside the traversing triangle, the yarn having been removed from guide means tends to advance in direction of the center of the traversing triangle.

In so doing, the yarn is somewhat braked by the guide arm 15, which follows the guide 16 and is still contacted by the yarn. In any event, before reaching the traversing stroke 30, the yarn forms on the empty bobbin a few winds, which will later serve as a transfer tail for connecting the yarn ends of two packages. As soon as the yarn enters into the traversing range, it is caught by the traversing yarn guide 11, and the reciprocation of the yarn starts. The yarn guide 11 has two lateral flanks which are inclined toward the traversing plane and form a triangle, which extends through the traversing plane. Consequently, the yarn guide 11 catches the yarn automatically. Since the suction tube connects horizontally adjacent winding stations, and since all guide means 16 therefore become ineffective at the same time, the traversing motion of all stations starts simultaneously.

FIGS. 6 and 7 show details of a suction tube 14, which, when being rotated in two directions 26 and 31, can be either connected with a suction line 40 or separated from same. The suction line 40 connects to a suction pump 41 and terminates on the side facing away from the pump in a valve housing 42, which accommodates a rotatable plug 43. The plug can be rotated, for example, by actuating a handle 44. The plug projects beyond the valve housing 42 on one side, its projecting portion being provided with an axial blind hole 45 extending therethrough. The suction tube 14 is inserted sealably against pressure over the projecting portion and can be rotated together with the plug. As can be seen, the jacket opening 27 in the suction tube 14 is rotated at the same time.

As can be seen in FIG. 7, the plug 43 is provided with a connecting radial opening 46, which connects the suction line 40 with the bore 45 when being rotated to a certain position. In the rotated position as illustrated, the connection is blocked. However, when being rotated anticlockwise by about 90°, the connection is completely open. In this position, the suction tube is in its suction position. The jacket openings 27 are arranged in such a manner that in the suction position their catching area grasps a yarn as it passes by. As an alternative embodiment, in the place of a plug valve for disconnecting the suction by interrupting the suction line, it is possible to use an electric rotary switch, which interrupts the power supply of the suction pump 41 when rotating the suction tube.

In the drawings and specification, there has been set forth a preferred embodiment of the invention, and although specific terms are employed, they are used in a generic and descriptive sense only and not for purposes of limitation.

That which is claimed is:

1. A yarn winding machine comprising a plurality of side by side yarn winding stations, with each of said yarn winding stations comprising (a) means for rotatably mounting a tubular yarn bobbin, (b) drive means for rotating the yarn bobbin and a yarn package being formed thereon, (c) yarn traversing means for engaging and reciprocating an advancing yarn and so as form a cross wound package on the rotating bobbin, (d) yarn cutting means, (e) suction means for withdrawing the advancing yarn upon the cutting of the yarn by said yarn cutting means, means mounting said yarn cutting means and said suction means of all of said yarn winding stations, for simultaneous movement between an operative position and an inoperative position, and whereby upon movement to said operative position at the end of a winding cycle, said yarn cutting means simultaneously cuts the yarns being processed at all of the winding stations and so that the yarns are withdrawn by said suction means to thereby permit the full packages to be replaced with empty bobbins, and said means mounting said yarn cutting means and said suction means comprising a suction tube which extends horizontally along the side by side winding stations, with said suction tube being rotatable about its longitudinal axis and having said yarn cutting means mounted to said suction tube, and with said suction means comprising an opening in said suction tube, and such that rotation of said suction tube defines said operative and said inoperative positions.

2. The yarn winding machine as defined in claim 1 wherein the yarn being reciprocated by said yarn traversing means defines a traversing plane, said yarn cutting means comprises a yarn cutting blade having a straight cutting edge, and wherein (1) in said inoperative position said means mounting said yarn cutting means positions said cutting blade so as to be spaced from said traversing plane, and (2) in said operative position said means mounting said cutting means positions said cutting blade in a predetermined orientation intersecting said traversing plane and such that the yarn, when reciprocated toward said cutting blade, is deflected from its path of travel by contact with said cutting edge and moves along the cutting edge with no substantial component of movement tranverse to said cutting edge, and such that the advancing yarn may be cleanly cut at a single point along its length.

3. The yarn winding machine as defined in claim 2 wherein in said operative position said cutting edge of said cutting blade is disposed along a line which obliquely intersects said traversing plane, and said cutting edge is also aligned along the resultant of the advancing movement of the yarn and the lateral reciprocating movement of the yarn when viewed in a direction perpendicular to said traversing plane.

4. The yarn winding machines as defined in claim 3 wherein said cutting blade defines a cutting plane, and wherein said means mounting said cutting means comprises a holder which includes a guide edge which is disposed in a plane parallel to the plane of said cutting blade and spaced laterally therefrom, with said guide edge, when viewed in a direction perpendicular to the plane of said cutting blade, crossing said cutting edge and forming with the same a wedge-shaped gap which closes in the direction of the yarn movement toward said cutting blade.

5. The yarn winding machine as defined in claim 1 further comprising a yarn trap mounted on said suction tube at each of said winding stations, with each yarn trap being positioned so as to catch the reciprocating yarn and hold the same adjacent the associated suction opening when said tube is rotated to said operative position.

6. The yarn winding machine as defined in claim 5 further comprising valve means for selectively applying a partial vacuum to the interior of said suction tube only when said tube is in said operative position.

7. The yarn winding machine as defined in claim 1 further comprising yarn guide means, and means mounting said yarn guide means of all of said yarn winding stations for simultaneous movement between an operative position and an inoperative position and so that in said operative position said yarn guide means guides the yarn onto an end portion of the rotating yarn bobbin to form a yarn reserve winding at the beginning of a winding cycle, and in said inoperative position the yarn is released from said yarn guide means and engaged by said yarn traversing means to commence the winding of a new package simultaneously at all winding stations.

8. A yarn winding machine comprising a plurality of side by side yarn winding stations, with each of said yarn winding stations comprising (a) means for rotatably mounting a tubular yarn bobbin, (b) drive means for rotating the yarn bobbin and a yarn package being formed thereon, (c) yarn traversing means for engaging and reciprocating an advancing yarn and so as form a cross wound package on the rotating bobbin, (d) yarn cutting means, (e) suction means for withdrawing the advancing yarn upon the cutting of the yarn by said yarn cutting means, (f) yarn guide means for guiding the advancing yarn onto an end portion of the rotating yarn bobbin to form a yarn reserve winding at the beginning of a winding cycle, and means mounting said yarn cutting means, said suction means, and said yarn guide means of all of said yarn winding stations, for simultaneous movement between an operative position and an inoperative position, and whereby (1) upon movement to said operative position at the end of a winding cycle, said yarn cutting means simultaneously cuts the yarns being processed at all of the winding stations and so that the yarns are withdrawn by said suction means to thereby permit the full packages to be replaced with empty bobbins, and such that yarn guide means of all of said processing stations may be utilized to guide the advancing yarns to the empty bobbins, and (2) upon movement to said inoperative position the yarns of all of said processing stations are simultaneously released from said yarn guide means and engaged by said yarn traversing means to commence the winding of a new package, and said means mounting said yarn cutting means, said suction means, and said yarn guide means comprising a suction tube which extends horizontally along the side by side winding stations, with said suction tube being rotatable about its longitudinal axis and having said yarn cutting means and said yarn guide means mounted to said suction tube, and with said suction means comprising an opening in said suction tube, and such that rotation of said suction tube defines said operative and said inoperative positions.

9. The yarn winding machine as defined in claim 8 further comprising a yarn trap mounted on said suction tube at each of said winding stations, with each yarn trap being positioned so as to catch the reciprocating yarn and hold the same adjacent the associated suction opening when said suction tube is rotated to said operative position.

* * * * *